US011213838B2

(12) United States Patent
Yamauchi

(10) Patent No.: US 11,213,838 B2
(45) Date of Patent: Jan. 4, 2022

(54) ROTARY ATOMIZING HEAD TYPE COATING MACHINE

(71) Applicant: ABB SCHWEIZ AG, Baden (CH)

(72) Inventor: Kuniharu Yamauchi, Nagakute (JP)

(73) Assignee: ABB SCHWEIZ AG, Baden (CH)

( * ) Notice: Subject to any disclaimer, the term of this patent is extended or adjusted under 35 U.S.C. 154(b) by 175 days.

(21) Appl. No.: 16/318,400

(22) PCT Filed: May 30, 2018

(86) PCT No.: PCT/JP2018/020812
§ 371 (c)(1),
(2) Date: Jan. 17, 2019

(87) PCT Pub. No.: WO2018/221611
PCT Pub. Date: Dec. 6, 2018

(65) Prior Publication Data

US 2019/0224699 A1 Jul. 25, 2019

(30) Foreign Application Priority Data

Jun. 1, 2017 (JP) ..... JP2017-109147

(51) Int. Cl.
*B05B 5/04* (2006.01)
*B05B 3/10* (2006.01)

(52) U.S. Cl.
CPC ..... *B05B 5/0407* (2013.01); *B05B 3/1014* (2013.01); *B05B 3/1092* (2013.01);
(Continued)

(58) Field of Classification Search
CPC ... B05B 3/1014; B05B 3/1064; B05B 3/1092; B05B 5/0407; B05B 5/0411; B05B 5/0415; B05B 5/0426
See application file for complete search history.

(56) References Cited

U.S. PATENT DOCUMENTS 9,604,233 B2 * 3/2017 Yamauchi ..... B05B 3/1092
10,016,770 B2 * 7/2018 Yamasaki ..... B05B 5/03
(Continued)

FOREIGN PATENT DOCUMENTS

CN 102015115 A 4/2011
CN 102056674 A 5/2011
(Continued)

OTHER PUBLICATIONS

International Search Report dated Aug. 14, 2018 in PCT/JP2018/020812 filed on May 30, 2018.
(Continued)

*Primary Examiner* — Alex M Valvis
(74) *Attorney, Agent, or Firm* — Oblon, McClelland, Maier & Neustadt, L.L.P.

(57) ABSTRACT

The coating machine is provided with an air motor (3), a rotational shaft (4) that is rotatably supported by the air motor (3), a feed tube (5) that extends to a tip end of the rotational shaft (4) through the inside of the rotational shaft (4), a rotary atomizing head (6) that is mounted to the tip end of the rotational shaft (4), and a shaping air ring (7) that surrounds an outer periphery of the rotary atomizing head (6) and an axial tip end of which is arranged in back of a paint releasing edge (6D) of the rotary atomizing head (6). The shaping air ring (7) includes a great number of first shaping air spurting holes (9), and a great number of second shaping air spurting holes (10). An inner diameter dimension (d1) of the first shaping air spurting hole (9) is set to be larger than an inner diameter dimension (d2) of the second shaping air spurting hole (10). The number (N2) of the second shaping air spurting holes (10) is set to be smaller than the number (N1) of the first shaping air spurting holes (9).

4 Claims, 7 Drawing Sheets

(52) U.S. Cl.
CPC ..... *B05B 5/0426* (2013.01); *B05B 3/1064* (2013.01); *B05B 5/0415* (2013.01)

(56) References Cited

U.S. PATENT DOCUMENTS

| | | | | |
|---|---|---|---|---|
| 2009/0314855 | A1 | 12/2009 | Seitz | |
| 2013/0040064 | A1* | 2/2013 | Shigekura | B05B 3/02 427/427.3 |
| 2017/0128969 | A1* | 5/2017 | Yamauchi | B05B 3/1014 |
| 2018/0008997 | A1* | 1/2018 | Medard | B05B 3/1014 |

FOREIGN PATENT DOCUMENTS

| | | | | |
|---|---|---|---|---|
| CN | 102950091 | A | 3/2013 | |
| CN | 105935632 | A | 9/2016 | |
| CN | 106457278 | A | 2/2017 | |
| CN | 109689218 | A | 4/2019 | |
| EP | 3 056 283 | A1 | 8/2016 | |
| EP | 3 269 454 | A1 | 1/2018 | |
| JP | H07265746 | * | 4/1994 | B05B 5/0407 |
| JP | 7-265746 | A | 10/1995 | |
| JP | 10-216567 | A | 8/1998 | |
| JP | 2004-305874 | A | 11/2004 | |
| JP | 2011-230013 | A | 11/2011 | |
| JP | 2012-115736 | A | 6/2012 | |
| JP | 2013-39509 | A | 2/2013 | |
| JP | 2013-188651 | A | 9/2013 | |
| KR | 10-0578007 | B1 | 5/2006 | |
| WO | WO 2016/163178 | A1 | 10/2016 | |

OTHER PUBLICATIONS

Combined Chinese Office Action and Search Report dated Aug. 5, 2020, in Patent Application No. 201880003518.7 (with English translation), 12 pages.

Extended European Search Report issued in European Patent Application No. 18810193.5 dated Nov. 24, 2020.

Combined Chinese Office Action and Search Report issued in Chinese Patent Application No. 2018800035187 dated Dec. 22, 2020, (w/ English Translation).

Chinese Office Action issued in Chinese Patent Application No. 201880003518.7 dated Jul. 21, 2021 (w/ English Translation).

Chinese Office Action issued in Chinese Patent Application No. 201880003518.7 dated May 19, 2021 (w/English Translation).

* cited by examiner

Fig .6

| COATING PART | PATTERN WIDTH (mm) (SIZE OF COATING PATTERN) | | SA FLOW AMOUNT (NL) (FIRST SA/SECOND SA) | SPURTING AMOUNT OF PAINT (cc/min) | ROTATING SPEED OF ROTARY ATOMIZING HEAD (krpm) |
|---|---|---|---|---|---|
| INNER SURFACE (INNER PLATE) | SMALLEST | 50~100 | 50~200/600 | 100~150 | 20~35 |
| | INTERMEDIATE | 200~300 | 400/400 | 200~300 | 25~45 |
| | | 300~400 | 400/200 | 200~400 | 30~55 |
| OUTER SURFACE (OUTER PLATE) | INTERMEDIATE | 200~300 | 400/400 | 200~300 | 25~45 |
| | | 300~400 | 400/50~200 | 200~400 | 25~55 |
| | LARGEST | 400~500 | 300/50~200 | 300~500 | 25~55 |

ROTARY ATOMIZING HEAD TYPE COATING MACHINE

TECHNICAL FIELD

The present invention relates to a rotary atomizing head type coating machine that is used suitably for coating a body of a vehicle.

BACKGROUND ART

In general, in a case of coating a body of a vehicle, a coating machine of a rotary atomizing head type that is excellent in a coating efficiency and coating finish of paint is used. This coating machine is configured of an air motor that uses compressed air as a power source, a hollow rotational shaft that is rotatably supported by the air motor and an axial tip end of which projects to a front side from the air motor, a feed tube that extends to the tip end of the rotational shaft through the inside of the rotational shaft to supply paint, a rotary atomizing head that is mounted to the tip end of the rotational shaft and a shaping air ring that is arranged on an outer periphery of the rotary atomizing head.

The rotary atomizing head is formed of an outer peripheral surface enlarged in a cup shape, an inner peripheral surface that spreads the paint supplied from the feed tube and a paint releasing edge that is positioned in an axial tip end to release the paint.

The shaping air ring is provided such that a tip end thereof is positioned in back of the paint releasing edge of the rotary atomizing head. The shaping air ring is arranged to surround the rotary atomizing head and is provided with a great number of first shaping air spurting holes that spurt first shaping air toward the periphery of the paint releasing edge and a great number of second shaping air spurting holes that are positioned to be closer to the radial inside than each of the first shaping air spurting holes and are arranged to surround the rotary atomizing head to spurt second shaping air along the outer peripheral surface of the rotary atomizing head.

The coating machine as configured in this way controls a flow amount of shaping air that will be spurted from the first shaping air spurting holes and the second shaping air spurting holes. There is known the configuration that in this way, a size of a coating pattern of paint to be sprayed from the rotary atomizing head in the coating machine is adjusted by the shaping air (Patent Document 1).

PRIOR ART DOCUMENT

Patent Document

Patent Document 1: Japanese Patent Laid-Open No. 2004-305874 A

SUMMARY OF THE INVENTION

In a case of coating the body of the vehicle with paint, the paint is sprayed to a position outward from an end part of a coating surface to form a uniform coating film to the end part of the coating surface. In this case, the coating machine is required to adjust a size of the coating pattern depending upon the width of the coating surface for suppressing the amount of the paint that is sprayed outward from the coating surface and is disposed and performing high-quality and good-efficient coating.

For example, in a case of coating a large outer surface of an engine hood, a roof, doors or the like forming the vehicular body, a large coating pattern is used to efficiently perform the coating. On the other hand, in a case of coating an elongated inner surface of pillars, radiator supports or the like, a small coating pattern is used to prevent the paint sprayed from the excessively large coating pattern from protruding outward from the coating surface.

However, the coating pattern cannot obtain sufficiently good coating performance by adjusting the size only, and is required to obtain a good coating film by spraying the paint to the coating surface uniformly. That is, in a case of easily changing only the size of the coating pattern, the coating pattern may become a double ring pattern as to be called a so-called double pattern. Consequently, it is difficult to stably adjust the coating pattern of the coating machine from the small coating pattern to the large coating pattern as described above. Therefore, the adjustment of the coating pattern is currently performed by using a plurality of kinds of coating machines which differ in a type depending upon a size of the coating pattern.

The present invention is made in view of the foregoing problems in the aforementioned conventional technology, and an object of the present invention is to provide a rotary atomizing head type coating machine that can adjust a coating pattern of paint in a wide range from a small pattern to a large pattern, and can perform good coating to coating objects different in a size.

A rotary atomizing head type coating machine according to the present invention comprises an air motor that uses compressed air as a power source, a hollow rotational shaft that is rotatably supported by the air motor and an axial tip end of which projects forward from the air motor, a feed tube that extends to the tip end of the rotational shaft through the inside of the rotational shaft to supply paint, a rotary atomizing head that is mounted to the tip end of the rotational shaft and includes an outer peripheral surface enlarged in a cup shape, an inner peripheral surface spreading paint supplied from the feed tube and a paint releasing edge that is positioned in the tip end to release the paint, and a shaping air ring that surrounds an outer periphery of the rotary atomizing head and an axial tip end of which is arranged in back of the paint releasing edge of the rotary atomizing head, the shaping air ring including: a great number of first shaping air spurting holes that spurt first shaping air toward the periphery of the paint releasing edge; and a great number of second shaping air spurting holes that are positioned to be closer to the radial inside than each of the first shaping air spurting holes and are arranged to surround the rotary atomizing head to spurt second shaping air along the outer peripheral surface of the rotary atomizing head.

The shaping air ring adopted by the present invention is characterized in that an inner diameter dimension of the first shaping air spurting hole is set to be larger than an inner diameter dimension of the second shaping air spurting hole, and the number of the second shaping air spurting holes is set to be smaller than the number of the first shaping air spurting holes.

According to the present invention, the coating pattern of the paint can be adjusted in a wide range from a small pattern to a large patter, and further, the good coating can be performed to coating objects different in a size.

BRIEF DESCRIPTION OF THE DRAWINGS

FIG. 6 is an explanatory diagram showing an example of various conditions for adjusting a coating pattern of the rotary atomizing head type coating machine.

MODE FOR CARRYING OUT THE INVENTION

Hereinafter, a rotary atomizing head type coating machine according to an embodiment of the present invention will be in detail explained with reference to FIG. 1 to FIG. 6. The present embodiment exemplifies a case of applying the rotary atomizing head type coating machine, which can adjust a coating pattern to three kinds of the smallest pattern, the largest pattern and the intermediate pattern, to coating a body of a vehicle with paint.

As to a rotary atomizing head type coating machine, there are an electrostatic coating machine that performs coating by applying a high voltage to paint to be sprayed, and a non-electrostatic coating machine that performs the coating without applying a high voltage to the paint. The embodiment to be hereinafter described will be explained by taking a rotary atomizing head type coating machine configured as an electrostatic coating machine of a direct charging type that applies a high voltage directly to paint, as an example. The coating is composed of base coating, clear coating and middle coating, and in the present embodiment, a case of performing the clear coating as finish coating will be described.

Figure 1:
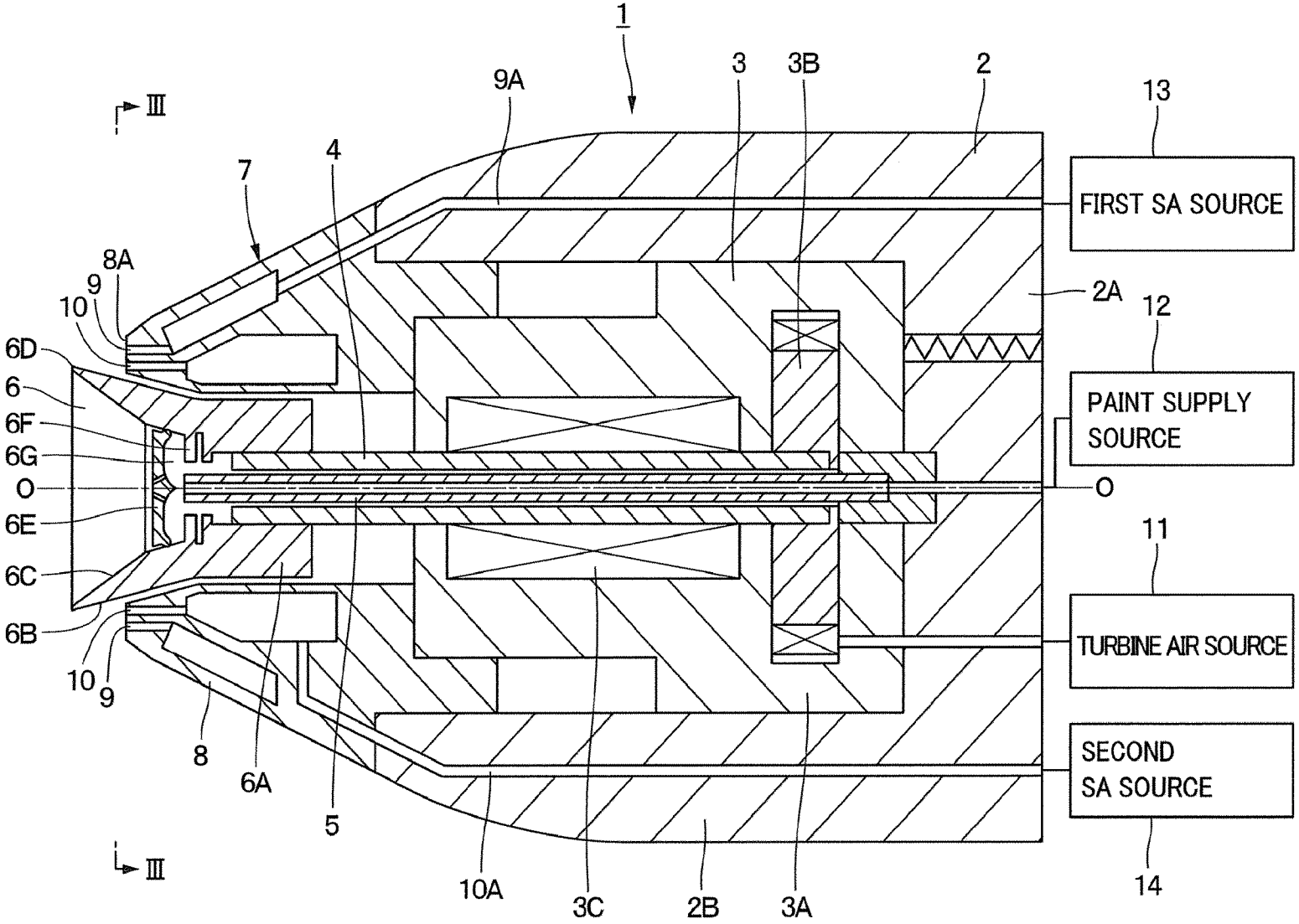
FIG. 1 is a longitudinal cross section showing a rotary atomizing head type coating machine according to an embodiment in the present invention.

In FIG. 1, a rotary atomizing head type coating machine 1 according to an embodiment of the present invention is configured as an electrostatic coating machine of a direct charging type that applies a high voltage directly to paint by a high voltage generator (not shown) (hereinafter, the rotary atomizing head type coating machine 1 is called "coating machine 1"). The coating machine 1 is mounted to a tip end of an arm (not shown) of a paint coating robot, for example. The coating machine 1 includes a housing 2, an air motor 3, a rotational shaft 4, a feed tube 5, a rotary atomizing head 6 and a shaping air ring 7, which will be described later.

The housing 2 includes a housing body 2A that is positioned backward and is formed in a disc shape, and a cylindrical cover 2B that extends from an outer peripheral side toward a front side of the housing body 2A. The housing body 2A is mounted to the tip end of the arm in the aforementioned paint coating robot through a holder for robot connection (not shown). The air motor 3 to be described later is mounted in the front side of the housing body 2A to be positioned within the cylindrical cover 2B. Further, abase end side of the feed tube 5 to be described later is fixedly mounted to the housing body 2A in a shaft central position thereof (axial line O-O of the rotational shaft 4 to be described later).

The air motor 3 is provided coaxially with the housing 2 (on the axial line O-O) in the housing 2. The air motor 3 rotates the rotational shaft 4 and the rotary atomizing head 6 at high speeds of, for example, 3 to 150 krpm (3000 to 150000 rpm) by using compressed air as a power source. The air motor 3 includes a stepped cylindrical motor case 3A mounted in the front side of the housing 2, a turbine 3B that is rotatably accommodated in a rear side position of the motor case 3A, and an air bearing 3C that is provided in the motor case 3A to rotatably support the rotational shaft 4.

Here, turbine air is supplied to the turbine 3B from a turbine air source 11 to be described later. A rotating speed of the turbine 3B, that is, a rotating speed of the rotary atomizing head 6 is controlled in accordance with a flow amount of the turbine air.

The rotational shaft 4 is formed as a tubular body that is rotatably supported on the air motor 3 through the air bearing 3C. The rotational shaft 4 is arranged in the motor case 3A to extend axially at the center of the axis line O-O. The rotational shaft 4 has a base end side (rear end side) that is integrally mounted in the center of the turbine 3B and has an axial tip end that projects forward from the motor case 3A. The rotary atomizing head 6 is mounted in a front end part of the rotational shaft 4.

The feed tube 5 extends through the inside of the rotational shaft 4 to an axial tip end of the rotational shaft 4. A tip end side of the feed tube 5 projects from the tip end of the rotational shaft 4 and extends into the rotary atomizing head 6. The base end side of the feed tube 5 is fixedly mounted to the housing body 2A of the housing 2 in a central position thereof. A paint flow passage in the feed tube 5 is connected to a paint supply source 12 to be described later including a color changing valve device.

The feed tube 5 supplies paint toward the rotary atomizing head 6 from the coating flow passage at the time of performing a coating work. On the other hand, at the time of performing a washing work of the adhered paint, washing fluids such as thinner or air, can be supplied toward the rotary atomizing head 6 from the paint flow passage. It should be noted that the feed tube 5 may be structured as a double tube arranged coaxially such that a central flow passage is formed as a paint flow passage and an outer annular flow passage is formed as a washing fluid flow passage.

The rotary atomizing head 6 is mounted in a tip end of the rotational shaft 4, and is formed in a cup shape enlarged from the rear side to the front side. The rotary atomizing head 6 rotates together with the rotational shaft 4 at high speeds by the air motor 3 to spray paint and the like to be supplied from the feed tube 5. The rotary atomizing head 6 has a base end side that constitutes a cylindrical mounting part 6A mounted to the tip end part of the rotational shaft 4. Here, the rotary atomizing head 6 has a diameter dimension of 40 mm in a paint releasing edge 6D to be described later, as one example. Besides, for example, a rotary atomizing head smaller in a diameter than a diameter dimension of 30 mm or a rotary atomizing head larger in a diameter than a diameter dimension of 50 mm may be used.

An outer peripheral surface 6B enlarged in a cup shape toward the front side and an inner peripheral surface 6C formed as a paint thin film surface that is largely enlarged in a funnel shape toward the front side to thin and spread the paint supplied from the feed tube 5 are provided in the front side of a mounting part 6A of the rotary atomizing head 6. A tip end position of the inner peripheral surface 6C is formed as the paint releasing edge 6D that releases paint in a tangential direction at rotating.

On the other hand, a disc-shaped hub member 6E is provided in the inside of the rotary atomizing head 6 to be positioned in the depth of the inner peripheral surface 6C. The hub member 6E smoothly introduces the paint supplied from the feed tube 5 to the inner peripheral surface 6C. Further, the rotary atomizing head 6 is provided with an annular partition wall 6F formed by reducing a diameter of the rotary atomizing head 6 in a position rearward of the hub member 6E and spaced therefrom. The annular partition wall 6F surrounds a tip end part of the feed tube 5 with a slight interval to form a paint reservoir 6G.

The paint is supplied to the rotary atomizing head 6 formed in this way from the feed tube 5 in a state of being rotated at high speeds by the air motor 3. Consequently, the rotary atomizing head 6 sprays the paint as countless paint particles atomized by centrifugal forces from the paint releasing edge 6D through the paint reservoir 6G, the hub member 6E and the inner peripheral surface 6C (paint thinned-film surface).

Next, descriptions will be made of the configuration of the shaping air ring 7 that is a characteristic section of the present invention.

The shaping air ring 7 is provided in an axial front side of the housing 2. The shaping air ring 7 has an axial tip end that is positioned closer to the rear side by a constant length than the paint releasing edge 6D of the rotary atomizing head 6 and is arranged to surround the periphery of the outer peripheral surface 6B of the rotary atomizing head 6. The shaping air ring 7 spurs shaping air from first shaping air spurting holes 9 and second shaping air spurting holes 10, which will be described later. Consequently, the shaping air ring 7 can atomize the paint to be sprayed from the paint releasing edge 6D of the rotary atomizing head 6 and adjust a coating pattern of the paint to a desired size and a desired shape.

The shaping air ring 7 includes a ring body 8, the first shaping air spurting holes 9 and the second shaping air spurting holes 10, which will be described later.

The ring body 8 is formed as a stepped cylindrical body surrounding the rotary atomizing head 6. A rear side of the ring body 8 is mounted to the cover tube 2B. Consequently, the ring body 8 fixes the air motor 3 in the inside of the cover tube 2B. On the other hand, an outer peripheral side of the ring body 8 is reduced in a diameter in a tapered shape toward the front side. Further, the first shaping air spurting holes 9 and the second shaping air spurting holes 10 are provided to be opened to a tip end surface 8A of the ring body 8.

The first shaping air spurting holes 9 are arranged to surround the rotary atomizing head 6. That is, the first shaping air spurting holes 9 comprise a great number of holes provided in series in the circumferential direction in a state of being opened to the tip end surface 8A of the shaping air ring 7. Each of the first shaping air spurting holes 9 is connected to a first shaping air source 13 (called "first SA source 13 in short), which will be described later, via a first air supply passage 9A. The first shaping air spurting hole 9 is formed as a circular hole having a small diameter. The first shaping air spurting hole 9 acts in a direction of widening the coating particles (in a direction of broadening the coating pattern) sprayed from the rotary atomizing head 6.

Here, the first shaping air spurting holes 9 comprise a great number of holes provided in the circumferential direction to surround an entire circumference of the rotary atomizing head 6. The number N1 of the first shaping air spurting holes 9 is set to be more than the number N2 of the second shaping air spurting holes 10 to be described later. That is, the number N1 of the first shaping air spurting holes 9 is set according to the following Formula 1 in a case where a diameter dimension of the paint releasing edge 6D in the rotary atomizing head 6 is 40 mm.

$$50 \leq N1 \leq 65, \text{ preferably } 55 \leq N1 \leq 60 \quad \text{[Formula 1]}$$

Figure 3:
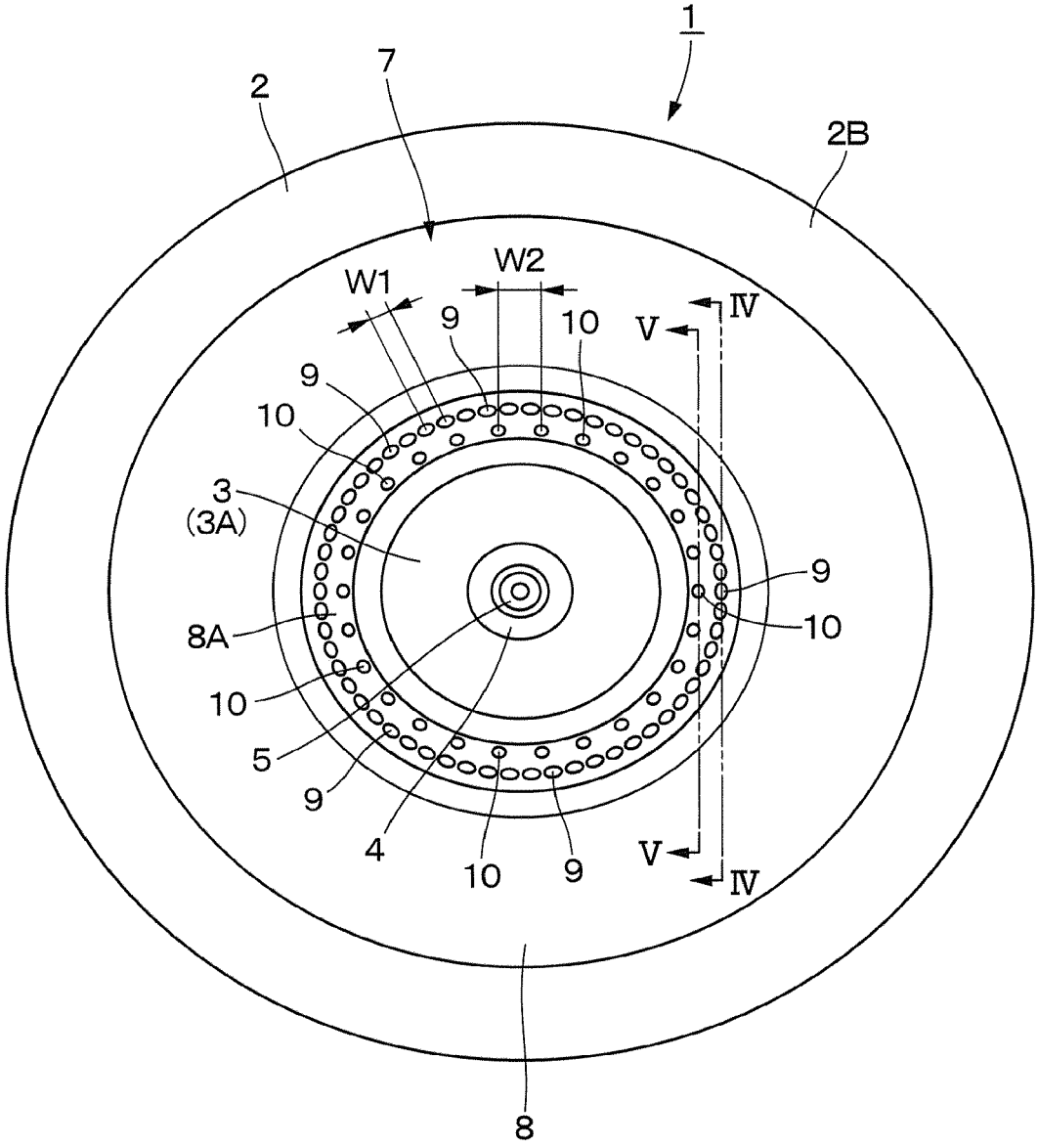
FIG. 3 is a transverse section showing the rotary atomizing head type coating machine with the rotary atomizing head being omitted as viewed in a direction of arrows III-III in FIG. 1.

In this case, as shown in FIG. 3, a interval dimension between the neighboring first shaping air spurting holes 9 is defined as a dimension W1. The interval dimension W1 is set according to the following Formula 2.

$$1.1 \text{ mm} \leq W1 \leq 1.8 \text{ mm} \quad \text{[Formula 2]}$$

Figure 4:
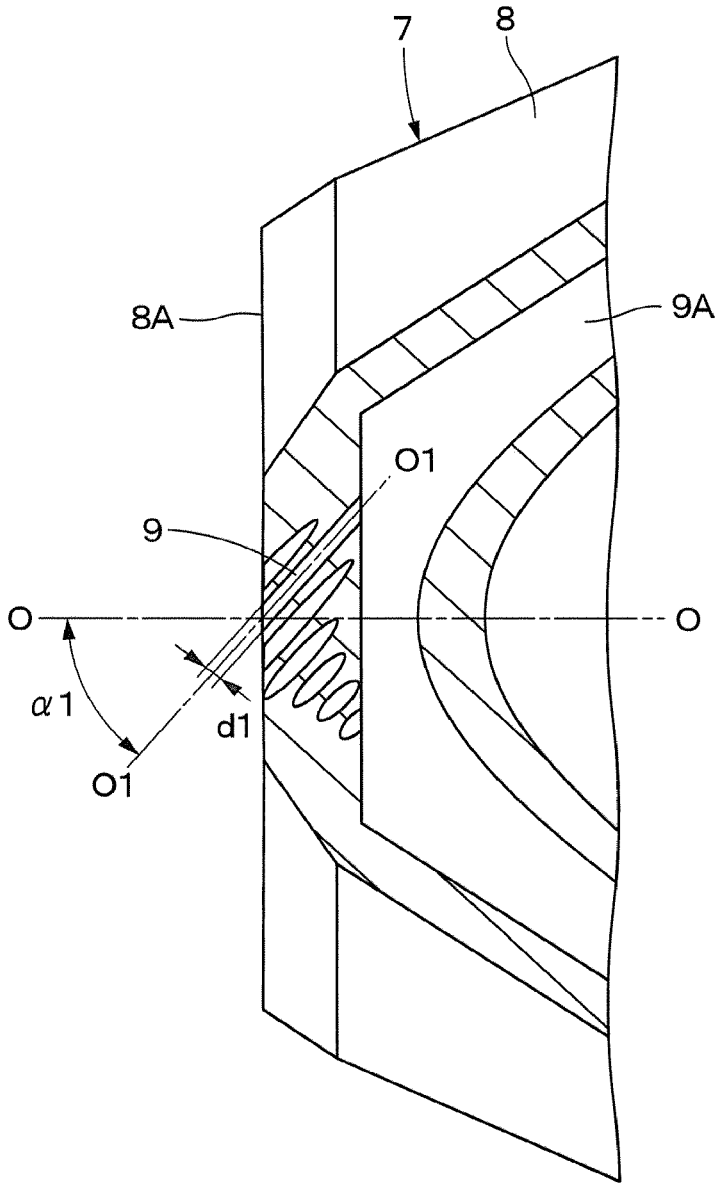
FIG. 4 is a longitudinal cross section showing a first shaping air spurting hole in the shaping air ring as viewed in a direction of arrows IV-IV in FIG. 3.

In addition, as shown in FIG. 4, an inner diameter dimension d1 of the first shaping air spurting hole 9 is set to a dimension larger than an inner diameter dimension d2 of the second shaping air spurting hole 10 to be described later. That is, the inner diameter dimension d1 in an open end of the first shaping air spurting hole 9 is set according to the following Formula 3.

$$0.8 \text{ mm} \leq d1 \leq 1.2 \text{ mm, preferably } 0.9 \text{ mm} \leq d1 \leq 1.1 \text{ mm} \quad \text{[Formula 3]}$$

On the other hand, an axial line O1-O1 of the first shaping air spurting hole 9 is inclined at an angle of $\alpha$1 in a direction in reverse to a rotating direction of the rotary atomizing head 6 to the axial line O-O of the rotational shaft 4. This inclined angle of $\alpha$1 is set according to the following Formula 4.

$$40 \text{ degrees} \leq \alpha 1 \leq 55 \text{ degrees, preferably } 48 \text{ degrees} \leq \alpha 1 \leq 52 \text{ degrees} \quad \text{[Formula 4]}$$

Figure 2:
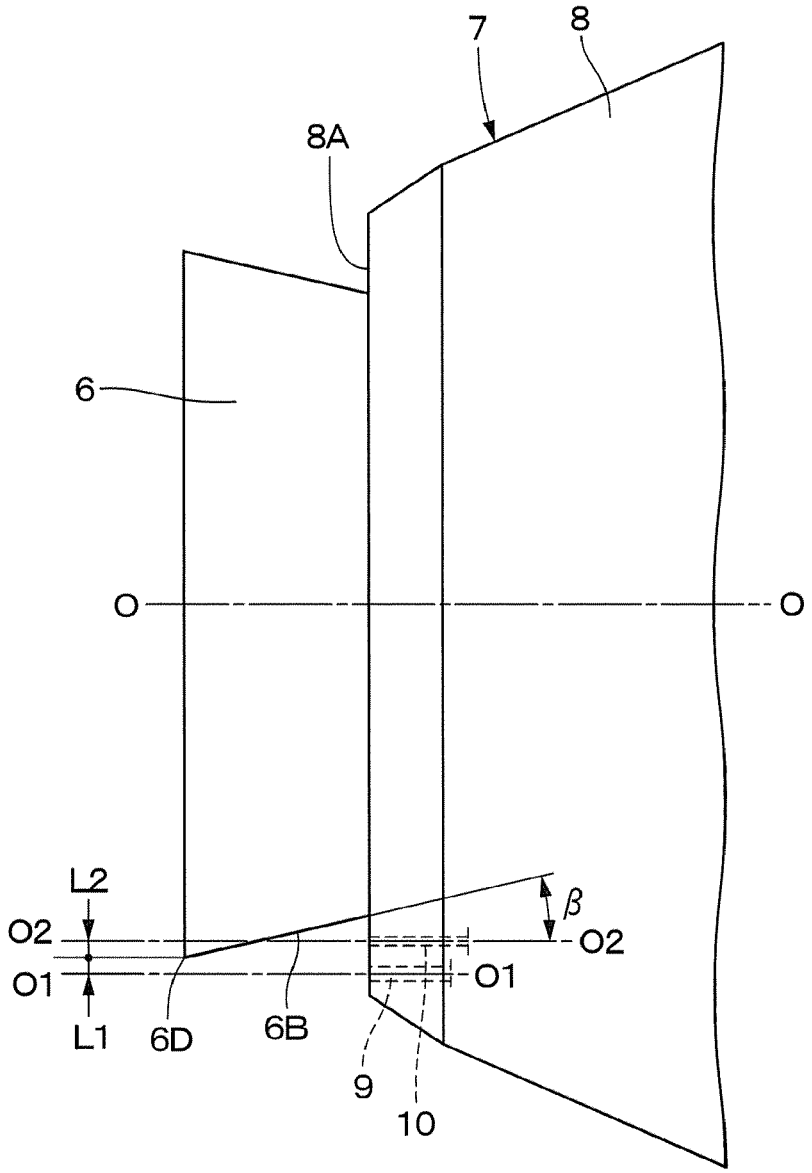
FIG. 2 is a front view showing a front part of a rotary atomizing head and a shaping air ring in an enlarging manner.

Further, the first shaping air spurting hole 9 blows first shaping air toward coating particles immediately after being released from the paint releasing edge 6D of the rotary atomizing head 6. Therefore, as shown in FIG. 2, the first shaping air spurting hole 9 is provided in a position of being away by a distance dimension L1 closer to the radial outside than the paint releasing edge 6D. In this case, the distance dimension L1 is set according to the following Formula 5.

$$4.5 \text{ mm} \leq L1 \leq 5.2 \text{ mm, preferably } 4.7 \text{ mm} \leq L1 \leq 4.9 \text{ mm} \quad \text{[Formula 5]}$$

The first shaping air spurting hole 9 is substantially in parallel with the axial line O-O in a radial direction (in a state as viewed in a direction shown in FIG. 2) of the rotational shaft 4 (the shaping air ring 7). A great number of the first shaping air spurting holes 9 formed in the above-mentioned condition cause the first shaping air to collide squarely with liquid threads of paint flying in a tangential direction from the paint releasing edge 6D of the rotary atomizing head 6. Consequently, the first shaping air spurting holes 9 can atomize the sprayed paint actively. In addition, the first shaping air spurting hole 9 can adjust a flow amount (flow speed) of the first shaping air to adjust a size of the coating pattern in cooperation with second shaping air to be described later.

The second shaping air spurting holes 10 are positioned closer to the radial inside than each of the first shaping air spurting holes 9 and are arranged to surround the rotary atomizing head 6. The second shaping air spurting hole 10 spurts the second shaping air along the outer peripheral surface 6B of the rotary atomizing head 6. The second shaping air spurting holes 10 are each formed as a circular hole having a small diameter in the substantially same way as the first shaping air spurting holes 9, and comprise a great number of holes provided in a state of being opened to the tip end surface 8A of the ring body 8 configuring the shaping air ring 7. The second shaping air spurting holes 10 are connected to a second shaping air source 14 (called "second SA source 14 in short), which will be described later, via a second air supply passage 10A. The second shaping air spurting holes 10 act in a direction of narrowing the coating particles (in a direction of reducing the coating pattern to be small) sprayed from the rotary atomizing head 6.

Here, the second shaping air spurting holes 10 comprise a great number of holes provided to surround an entire circumference in the circumferential direction between the rotary atomizing head 6 and the first shaping air spurting holes 9. The number of the second shaping air spurting holes 10 is set to be less than the number of the first shaping air spurting holes 9. That is, the number N2 of the second shaping air spurting holes 10 is set according to the following Formula 6 in a case where a diameter dimension of the paint releasing edge 6D in the rotary atomizing head 6 is 40 mm.

$$22 \leq N2 \leq 30, \text{ preferably } 24 \leq N2 \leq 28 \quad \text{[Formula 6]}$$

Here, the number N2 of the second shaping air spurting holes 10 has a relation of the following Formula 7 to the number N1 of the first shaping air spurting holes 9.

$$\tfrac{1}{3}N1 \leq N2 \leq \tfrac{1}{2}N1 \quad \text{[Formula 7]}$$

In this case, as shown in FIG. 3, an interval dimension between the neighboring second shaping air spurting holes 10 is defined as a dimension W2. The interval dimension W2 is set to a value larger than the interval dimension W1 between the first shaping air spurting holes 9, that is, in a range of the following Formula 8.

$$2.2 \text{ mm} \leq W2 \leq 2.4 \text{ mm} \quad \text{[Formula 8]}$$

Figure 5:
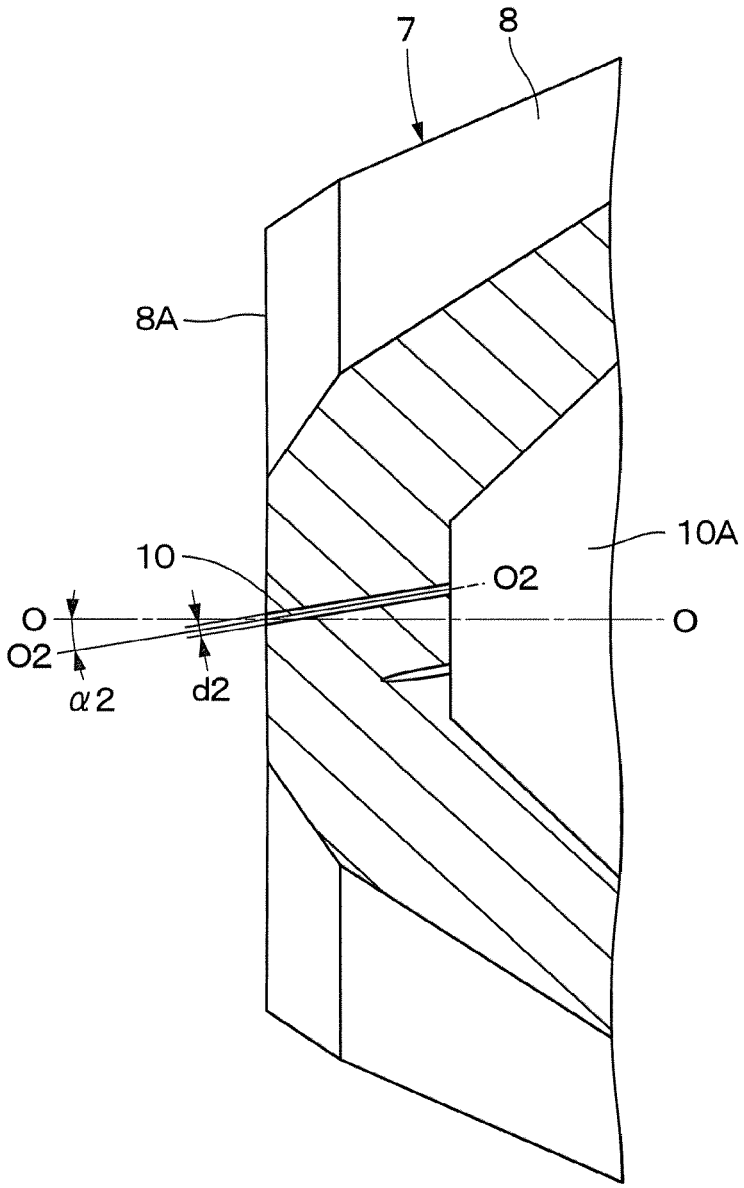
FIG. 5 is a longitudinal cross section showing a second shaping air spurting hole in the shaping air ring as viewed in a direction of arrows V-V in FIG. 3.

In addition, as shown in FIG. 5, an inner diameter dimension d2 of the second shaping air spurting hole 10 is set to a dimension smaller than the inner diameter dimension d1 of the first shaping air spurting hole 9. That is, the inner diameter dimension d2 in an open end of the second shaping air spurting hole 10 is set according to the following Formula 9.

$$0.5 \text{ mm} \leq d2 \leq 0.8 \text{ mm, preferably } 0.56 \leq \text{mm } d2 \leq 0.7 \text{ mm} \quad \text{[Formula 9]}$$

In this way, the number N1 of the first shaping air spurting holes 9 is set to be more than the number N2 of the second shaping air spurting holes 10. In addition, the inner diameter dimension d1 in the open end of the first shaping air spurting hole 9 is set to a dimension larger than the inner diameter dimension d2 in the open end of the second shaping air spurting hole 10. Accordingly, the flow speed of the first shaping air that is spurted from the first shaping air spurting hole 9 can be lowered without changing a supply amount of air. Consequently, it is possible to fix the defect called the double pattern that occurs in a case where the flow speed of the first shaping air is high. Further, the good coating state can be maintained and the coating pattern can be reduced to be small in a diameter.

On the other hand, the number N2 of the second shaping air spurting holes 10 is set to be less than the number N1 of the first shaping air spurting holes 9. In addition, the inner diameter dimension d2 in the open end of the second shaping air spurting hole 10 is set to a dimension smaller than the inner diameter dimension d1 in the open end of the first shaping air spurting hole 9. Accordingly, in a case where the supply amount of air is the same, the flow speed of the second shaping air that is spurted from each of the second shaping air spurting holes 10 can be increased. Consequently, the second shaping air can maintain the good coating state in cooperation with the first shaping air and can widen the coating pattern.

On the other hand, the axial line O2-O2 of the second shaping air spurting hole 10 is inclined at an angle of $\alpha$2 in a direction in reverse to the rotational direction of the rotary atomizing head 6 to the axial line O-O of the rotational shaft 4. This inclined angle of $\alpha$2 is set to a value smaller than the inclined angle of $\alpha$1 of the first shaping air spurting hole 9, that is, set according to the following Formula 10.

$$8 \text{ degrees} \leq \alpha 2 \leq 15 \text{ degrees, preferably } 9 \text{ degrees} \leq \alpha 2 \leq 11 \text{ degrees} \quad \text{[Formula 10]}$$

Further, each of the second shaping air spurting holes 10 spurts the second shaping air along the outer peripheral surface 6B of the rotary atomizing head 6. Therefore, as shown in FIG. 2, the second shaping air spurting hole 10 is provided in a position (position overlapping the rotary atomizing head 6 as viewed from the front plane) of being away by a distance dimension L2 closer to the radial inside than the paint releasing edge 6D. In this case, the distance dimension L2 is set according to the following Formula 11.

$$4.0 \text{ mm} \leq L2 \leq 4.5 \text{ mm, preferably } 4.1 \text{ mm} \leq L2 \leq 4.3 \text{ mm} \quad \text{[Formula 11]}$$

As shown in FIG. 2, the second shaping air spurting hole 10 is substantially in parallel with the axial line O-O in a radial direction of the rotational shaft 4 (the shaping air ring 7). Besides, the second shaping air spurting hole 10 is set such that the spurted second shaping air collides with the outer peripheral surface 6B of the rotary atomizing head 6 at an angle of $\beta$ (an incident angle $\beta$ of the second shaping air to the outer peripheral surface 6B). The incident angle $\beta$ of the second shaping air is set according to the following Formula 12.

$$12.0 \text{ degrees} \leq \beta \leq 13.4 \text{ degrees, preferably } 13.0 \text{ degrees} \leq \beta \leq 13.2 \text{ degrees} \quad \text{[Formula 12]}$$

In this case, when the incident angle $\beta$ of the second shaping air becomes large, the second shaping air collides with the outer peripheral surface 6B of the rotary atomizing head 6 to be scattered. On the other hand, when the incident angle $\beta$ of the second shaping air becomes small, the second shaping air collides directly with the coating particles sprayed from the rotary atomizing head 6 to cause a shape of the coating pattern to be unstable. In contrast, when the incident angle $\beta$ of the second shaping air is set in a range of the aforementioned value, the second shaping air can be made stable to obtain a good coating pattern.

The second shaping air spurting hole 10 formed on the above-mentioned condition causes the second shaping air to collide with liquid threads of paint separated from the paint releasing edge 6D of the rotary atomizing head 6. Consequently, the second shaping air spurting hole 10 can suppress wasteful spreading of coating particles to stabilize the coating pattern. In addition, the second shaping air spurting hole 10 can adjust a flow amount (flow speed) of the second shaping air to adjust a size of the coating pattern in cooperation with the first shaping air.

Here, an explanation will be made of an example with respect to a method for adjusting a size of the coating pattern by the coating machine 1 with reference to FIG. 6. An inner surface described in FIG. 6 is an inner surface (inner plate) of the body in the vehicle, and many small coating patterns are used at coating. On the other hand, an outer surface is an outer surface (outer plate) of the body in the vehicle, and many large coating patterns are used at coating.

In a case of switching a size (pattern width) of the coating pattern to 50 to 100 mm, 200 to 300 mm, 300 to 400 mm or 400 to 500 mm, the flow amount (first SA flow amount) of the first shaping air, the flow amount (second SA flow amount) of the second shaping air, and the spurting amount of paint and the rotating speed of the rotary atomizing head 6 each are controlled to a desired value. It should be noted that the dimension of the aforementioned coating pattern is applied to a case of finish coating (clear coating). For example, in a case of applying first coating (primer coating), each dimension is set to be larger by approximately 100 mm.

The coating pattern of the coating machine 1 to be used in the present embodiment includes three kinds of the smallest pattern, the intermediate pattern and the largest pattern. Here, the smallest pattern is in a range of 1.0 to 2.5 times as small as the diameter dimension of the rotary atomizing head 6. In a case where the diameter dimension of the rotary atomizing head 6 is 40 mm, the pattern width is 50 to 100 mm. The largest pattern is in a range of 10 to 12 times as large as the diameter dimension of the rotary atomizing head 6. In a case where the diameter dimension of the rotary atomizing head 6 is 40 mm, the pattern width is 400 to 500 mm. Further, the intermediate pattern is between the smallest pattern and the largest pattern. It should be noted that the intermediate pattern has a pattern width that is classified into a small-width intermediate pattern of 200 to 300 mm and a large-width intermediate pattern of 300 to 400 mm. The coating machine 1 can adjust the coating pattern to three kinds of coating patterns in which a size of the pattern is over a wide range while keeping the good atomized state. As a result, one kind of coating machine 1 can be used for the coating of coating objects having coating surfaces that differ in a size or shape, such as inner surface coating and outer surface coating of the body in the vehicle.

In a case of applying the finish coating by using the coating machine 1 according to the present embodiment, the flow amount of the shaping air, the flow amount of the paint and the rotating speed of the rotary atomizing head 6 are controlled for obtaining a desired coating pattern and a desired film thickness. As an example thereof, the smallest pattern (50 to 100 mm) is formed by increasing the flow amount of the second shaping air to be larger than the flow amount of the first shaping air, reducing the flow amount of the paint and lowering the rotating speed of the rotary atomizing head 6. The largest pattern (400 to 500 mm) is formed by reducing the flow amount of the second shaping air to be smaller than the flow amount of the first shaping air, increasing the flow amount of the paint to be large and increasing the rotating speed of the rotary atomizing head 6 to be high. Further, in the intermediate pattern (200 to 400 mm), the flow amount of the first shaping air, the flow amount of the second shaping air, the flow amount of the paint and the rotating speed of the rotary atomizing head 6 each are set to an intermediate value of the aforementioned respective values. It should be noted that the smallest pattern may be formed by increasing the rotating speed of the rotary atomizing head 6, and the largest pattern may be formed by lowering the rotating speed of the rotary atomizing head 6.

The rotary atomizing head type coating machine 1 according to the present embodiment has the configuration as described above, and next, an explanation will be made of an operation at the time of performing the coating work by using this coating machine 1.

First, the compressed air is supplied to the turbine 3B of the air motor 3 from the turbine air source 11, and the rotational shaft 4 and the rotary atomizing head 6 rotate at high speeds by the air motor 3. In this state, the paint selected by the color changing valve device of the paint supply source 12 is supplied to the rotary atomizing head 6 from the paint flow passage in the feed tube 5. Consequently, the rotary atomizing head 6 sprays the supplied paint as coating particles.

In this case, the rotary atomizing head 6 is impressed at a high voltage through the housing 2, the rotational shaft 4 and the like. Consequently, the coating particles to be sprayed from the rotary atomizing head 6 can be made in a state of being charged with the high voltage. The coating particles to be sprayed from the rotary atomizing head 6, that is, the charged coating particles can fly toward the body of the vehicle as the coating object connected to the earth, which can be efficiently coated therewith.

On the other hand, at the time of spraying the paint from the rotary atomizing head 6, the shaping air is spurted from the first shaping air spurting holes 9 and the second shaping air spurting holes 10 of the shaping air ring 7 for the atomization of the sprayed paint and the adjustment of the coating pattern.

In a case of spurting the first shaping air, the compressed air is supplied through the first air supply passage 9A from the first shaping air source 13, and the first shaping air is spurted from each of the first shaping air spurting holes 9. At this time, the first shaping air spurting hole 9 is inclined and opens in a direction in reverse to the rotational direction of the rotary atomizing head 6. Consequently, the first shaping air can collide squarely with liquid threads of paint flying in a tangential direction from the paint releasing edge 6D of the rotary atomizing head 6 and can atomize this paint.

On the other hand, in a case of spurting the second shaping air, the compressed air is supplied through the second air supply passage 10A from the second shaping air source 14, and the second shaping air is spurted from each of the second shaping air spurting holes 10. At this time, the second shaping air spurting holes 10 supply the second shaping air toward the outer peripheral surface 6B of the rotary atomizing head 6. Consequently, the second shaping air can adjust a size of the coating pattern widely in cooperation with the first shaping air.

Thus according to the present embodiment, the rotary atomizing head type coating machine 1 comprises the air motor 3 that uses the compressed air as the power source, the hollow rotational shaft 4 that is rotatably supported by the air motor 3 and the tip end of which projects axially forward from the air motor 3, the feed tube 5 that extends to the tip end of the rotational shaft 4 through the inside of the rotational shaft 4 to supply the paint, the rotary atomizing head 6 that is mounted to the tip end of the rotational shaft 4 and includes the outer peripheral surface 6B enlarged in the cup shape, the inner peripheral surface 6C spreading the paint supplied from the feed tube 5 and the paint releasing edge 6D positioned in the tip end to release the paint, and the shaping air ring 7 that surrounds the outer peripheral of the rotary atomizing head 6 and the axial tip end of which is arranged in back of the paint releasing edge 6D of the rotary atomizing head 6.

The shaping air ring 7 includes a great number of the first shaping air spurting holes 9 that spurt the first shaping air toward the periphery of the paint releasing edge 6D and a great number of the second shaping air spurting holes 10 that are positioned to be closer to the radial inside than each of the first shaping air spurting holes 9 and are arranged to surround the rotary atomizing head 6 to spurt the second shaping air along the outer peripheral surface 6B of the rotary atomizing head 6.

The inner diameter dimension d1 of the first shaping air spurting hole 9 is set to the dimension larger than the inner diameter dimension d2 of the second shaping air spurting hole 10, and the number N2 of the second shaping air spurting holes 10 is set to be smaller than the number N1 of the first shaping air spurting holes 9.

Based upon this, the inner diameter dimension d1 of the first shaping air spurting hole 9 is set to 0.8≤mm d1≤1.2 mm, and the inner diameter dimension d2 of the second shaping air spurting hole 10 is set to 0.5 mm≤d2≤0.8 mm.

The number N2 of the second shaping air spurting holes 10 is set to ⅓N1≤N2≤½N1 of the number N1 of the first shaping air spurting holes 9.

In addition, the inclined angle of α1 of the first shaping air spurting hole 9 is set to 40 degrees≤α1≤55 degrees relative to the axial line O-O of the rotational shaft 4. On the other hand, the inclined angle of α2 of the second shaping air spurting hole 10 is set to 8 degrees≤α2≤15 degrees relative to the axial line O-O of the rotational shaft 4.

Further, the incident angle of the second shaping air to be spurted from the second shaping air spurting hole 10 to the outer peripheral surface 6B of the rotary atomizing head 6 is set to 12 degrees≤β≤13.4 degrees.

Accordingly, the single coating machine 1 having the same structure can adjust the size of the coating pattern to three kinds of the smallest pattern (50 to 100 mm), the largest pattern (400 to 500 mm) and the intermediate pattern (200 to 400 mm), and further, can make the sprayed state of the paint at this time good.

As a result, the single coating machine 1 can coat various coating objects that differ in a size or shape. For example, it is possible to efficiently coat even the body of the vehicle in which required coating patterns differ between the inner surface and the outer surface, by only the single coating machine 1.

In addition, the number N1 of the first shaping air spurting holes 9 is set to be more than the number N2 of the second shaping air spurting holes 10. In addition, the inner diameter dimension d1 in the open end of the first shaping air spurting hole 9 is set to a value larger than the inner diameter dimension d2 in the open end of the second shaping air spurting hole 10. Accordingly, the flow speed of the first shaping air that is spurted from the first shaping air spurting hole 9 can be lowered without changing the supply amount of air. Consequently, it is possible to fix the defect such as the double pattern that occurs in a case where the flow speed of the first shaping air is high. In addition, the good coating state can be maintained and the coating pattern can be reduced to be small in a diameter.

On the other hand, the number N2 of the second shaping air spurting holes 10 is set to be less than the number N1 of the first shaping air spurting holes 9. In addition, the inner diameter dimension d2 in the open end of the second shaping air spurting hole 10 is set to be smaller than the inner diameter dimension d1 in the open end of the first shaping air spurting hole 9. Accordingly, in a case where the supply amount of air is set to the same, the flow speed of the second shaping air that is spurted from each of the second shaping air spurting holes 10 can be increased. Consequently, the second shaping air can maintain the good coating state in cooperation with the first shaping air and can increase the coating pattern to be large.

Figure 7:
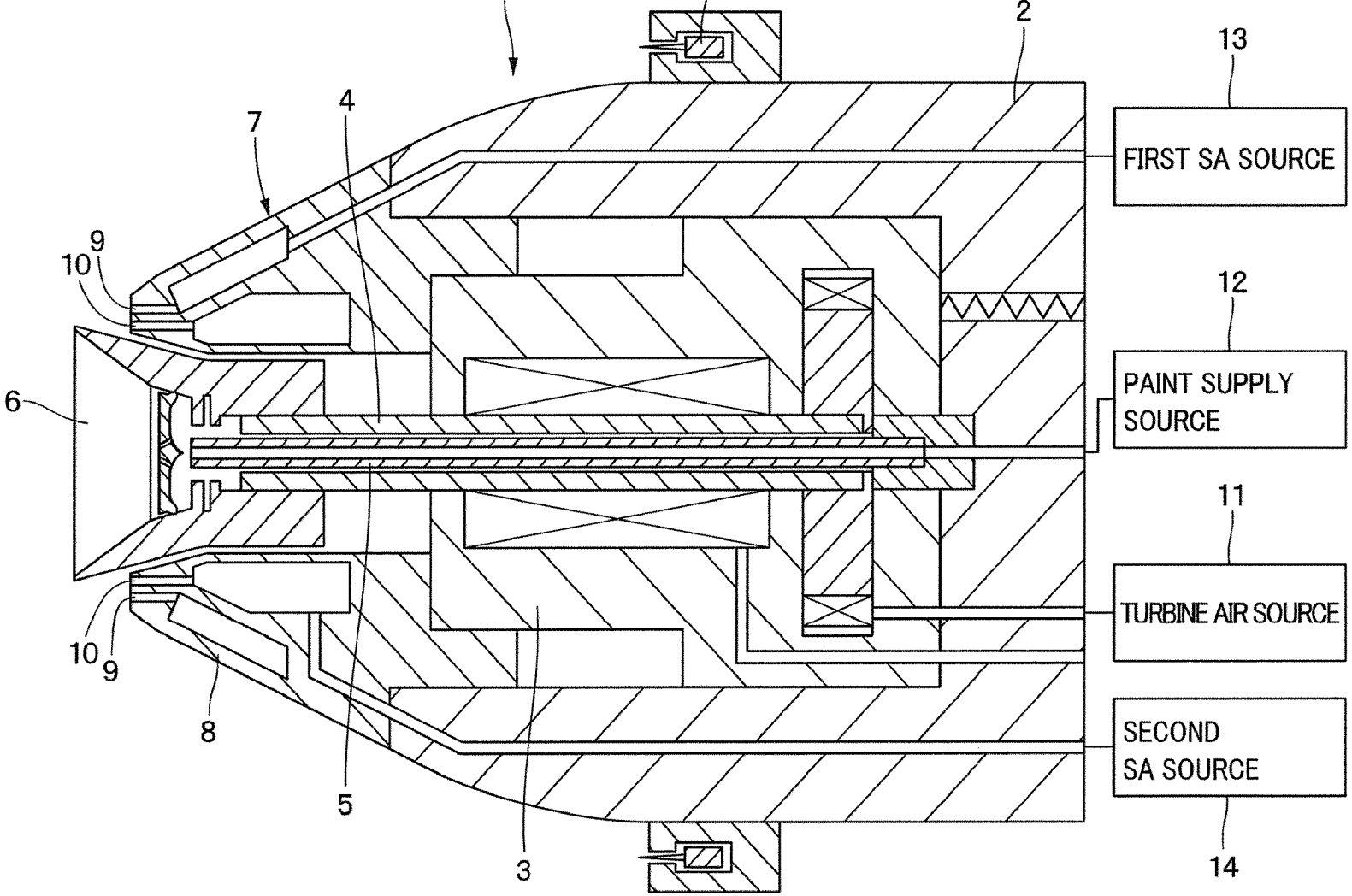
FIG. 7 is a longitudinal cross section showing a rotary atomizing head type coating machine of an indirect charging type according to a modification of the present invention.

It should be noted that in the embodiment, the rotary atomizing head type coating machine 1 is explained by taking the electrostatic coating machine of a direct charging type that applies a high voltage directly to the paint to be supplied to the rotary atomizing head 6, as an example. However, the present invention is not limited thereto, but may be configured as a modification shown in FIG. 7. That is, a rotary atomizing head type coating machine 21 may be configured as an indirect charging type coating machine that is provided with an external electrode 22 that applies a high voltage in an outer peripheral position of the housing 2 and in which the high voltage is applied to coating particles sprayed from the rotary atomizing head 6 by the apply from the external electrode 22. Further, the present invention may be applied to a non-electrostatic coating machine without applying a high voltage to paint.

In addition, the embodiment shows a case of using the rotary atomizing head 6 having a diameter dimension of 40 mm as an example. However, the present invention is not limited thereto, but may be configured to use a rotary atomizing head having a diameter dimension equal to or less than 30 mm, or equal to or more than 50 mm. In the rotary atomizing head having the diameter dimension of 30 mm, the number of the first shaping air spurting holes becomes 40 to 45, and the number of the second shaping air spurting holes becomes 24 to 30. In this case, the interval dimension between the neighboring first shaping air spurting holes is set to a range of 2.2 mm to 2.8 mm. Further, the interval dimension between the neighboring second shaping air spurting holes is set to a range of 3.0 mm to 3.8 mm.

On the other hand, in the rotary atomizing head having the diameter dimension of 50 mm, the number of the first shaping air spurting holes becomes 65 to 75, and the number of the second shaping air spurting holes becomes 28 to 38. In this case, the interval dimension between the neighboring first shaping air spurting holes is set to a range of 1.1 mm to 1.8 mm. Further, the interval dimension between the neighboring second shaping air spurting holes is set to a range of 2.2 mm to 2.4 mm.

DESCRIPTION OF REFERENCE NUMERALS

1, 21: Rotary atomizing head type coating machine
3: Air motor
4: Rotational shaft
5: Feed tube
6: Rotary atomizing head
6B: Outer peripheral surface
6C: Inner peripheral surface
6D: Paint releasing edge
7: Shaping air ring
9: First shaping air spurting hole
10: Second shaping air spurting hole
O-O: Axial line of a rotational shaft
N1: Number of first shaping air spurting holes
N2: Number of second shaping air spurting holes
d1: Inner diameter dimension in an open end of a first shaping air spurting hole
d2: Inner diameter dimension in an open end of a second shaping air spurting hole
α1: Angle of an axial line of a first shaping air spurting hole to an axial line of a rotational shaft
α2: Angle of an axial line of a second shaping air spurting hole to an axial line of a rotational shaft
L1: Radial distance dimension between a paint releasing edge and a first shaping air spurting hole
L2: Radial distance dimension between a paint releasing edge and a second shaping air spurting hole
β: Incident angle of a second shaping air to an outer peripheral surface of a rotary atomizing head

The invention claimed is:

1. A rotary atomizing head type coating machine comprising:

an air motor that uses compressed air as a power source;

a hollow rotational shaft that rotates about an axial line (O-O) of the rotational shaft and is rotatably supported by said air motor and an axial tip end of which projects forward from said air motor;

a feed tube that extends to the tip end of said rotational shaft through the inside of said rotational shaft to supply paint;

a rotary atomizing head that is mounted to the tip end of said rotational shaft and includes an outer peripheral surface enlarged in a cup shape, an inner peripheral surface spreading paint supplied from said feed tube and a paint releasing edge positioned in the tip end to release the paint; and a shaping air ring that surrounds an outer periphery of said rotary atomizing head and an axial tip end of which is arranged in back of said paint releasing edge of said rotary atomizing head, said shaping air ring including:

a plurality of first shaping air spurting holes that spurt first shaping air toward the periphery of said paint releasing edge; and a plurality of second shaping air spurting holes that are positioned to be closer to the radial inside than each of said first shaping air spurting holes and are arranged to surround said rotary atomizing head to spurt second shaping air along said outer peripheral surface of said rotary atomizing head, wherein an inner diameter dimension (d1) of said first shaping air spurting hole at an open end of the first shaping spurting hole is larger than an inner diameter dimension (d2) of said second shaping air spurting hole at an open end of the second shaping spurting hole; and the number (N2) of said second shaping air spurting holes is set to be smaller than the number (N1) of said first shaping air spurting holes, wherein an incident angle of (β) of the second shaping air to be spurted from said second shaping air spurting hole to said outer peripheral surface of said rotary atomizing head is set to 12.0 degrees≤β≤13.4 degrees, wherein the plurality of first shaping air spurting holes are positioned to a radial outside of the paint releasing edge with respect to the axial line of the rotational shaft, the first shaping air spurting holes being positioned at a distance L1 to the radial outside of the paint releasing edge, where 4.7 mm≤L1≤4.9 mm, and wherein the plurality of second shaping air spurting holes are positioned to a radial inside of the paint releasing edge with respect to the axial line of the rotational shaft, the second shaping air spurting holes being positioned at a distance L2 to the radial inside of the paint releasing edge, where 4.0 mm≤L2≤4.5 mm.

2. The rotary atomizing head type coating machine according to claim 1, wherein an inner diameter dimension (d1) of said first shaping air spurting hole is set to 0.8 mm≤d1≤1.2 mm, and an inner diameter dimension (d2) of said second shaping air spurting hole is set to 0.5 mm≤d2≤0.8 mm.

3. The rotary atomizing head type coating machine according to claim 1, wherein the number (N2) of said second shaping air spurting holes is set to ⅓N1≤N2≤½N1 to the number (N1) of said first shaping air spurting holes.

4. The rotary atomizing head type coating machine according to claim 1, wherein an inclined angle of (α1) of said first shaping air spurting hole is set to 40 degrees≤α1≤55 degrees relative to the axial line (O-O) of said rotational shaft, and an inclined angle of (α2) of said second shaping air spurting hole is set to 8 degrees≤α2≤15 degrees relative to the axial line (O-O) of said rotational shaft.

* * * * *